US005609308A

United States Patent [19]

Thom, Jr. et al.

[11] Patent Number: 5,609,308

[45] Date of Patent: Mar. 11, 1997

[54] FINE ADJUSTMENT/QUICK ACTING MANUAL ACTUATOR FOR ROLLER MILL FEED GATES

[75] Inventors: Kelsey C. Thom, Jr., Cedar Falls; Heath L. Hartwig, Waterloo, both of Iowa

[73] Assignee: California Pellet Mill Company, Nashua, N.H.

[21] Appl. No.: 543,431

[22] Filed: Oct. 16, 1995

[51] Int. Cl.[6] ..... B02C 4/28

[52] U.S. Cl. ..... 241/301; 241/224

[58] Field of Search ..... 241/301, 37, 227, 241/230–236, 224, 32, 226, 225, 222, 34

[56] References Cited

U.S. PATENT DOCUMENTS

| | | | |
|---|---|---|---|
| 3,881,663 | 5/1975 | Brown | 241/230 X |
| 4,140,285 | 2/1979 | Linzberger et al. | 241/232 |
| 5,072,887 | 12/1991 | Thom, Jr. | 241/37 |
| 5,379,955 | 1/1995 | McGraw | 241/224 |

FOREIGN PATENT DOCUMENTS

| | | | |
|---|---|---|---|
| 178258 | 4/1954 | Germany | 241/301 |
| 3407534 | 9/1985 | Germany | 241/224 |

*Primary Examiner*—Mark Rosenbaum
*Attorney, Agent, or Firm*—Michael H. Minns

[57] ABSTRACT

A manually actuated mechanism for roller mill feed gates that features both fine adjust and quick acting actuation. The mechanism consists of a hand wheel attached to an acme threaded rod, both of which are mounted in a bracket, the rod is attached to a clevis which is attached to a linkage and lever that is attached to the feed gate shaft. The fine adjust and quick action is accomplished by the lever which is spring loaded by tension spring. The lever has a half round acme nut that engages the acme threaded rod. The lever is normally held engaged to the rod by the spring for fine adjust but can be pulled by hand to release the rod for quick acting adjustment.

9 Claims, 2 Drawing Sheets

FINE ADJUSTMENT/QUICK ACTING MANUAL ACTUATOR FOR ROLLER MILL FEED GATES

BACKGROUND OF THE INVENTION

This invention relates generally to roller mill feed gates and more particularly to manual actuators for roller mill feed gates.

Manual actuators for roller mill feed gates have been made for two separate types of actuation, fine adjustment and quick acting. The reason for both types of action are: 1) fine adjustment is used for gradually adjusting the feed flow rate to being the roller mill up to full operating load; 2) quick acting is necessary to shut off the flow of feed to the roller mill to avoid an overload or choke-up. There have been unsuccessful attempts to incorporate the two types of action in the same mechanism.

The foregoing illustrates limitations known to exist in present manual actuators for roller mill feed gates. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus for adjusting a feed gate, the apparatus comprising: a lever actuator; a threaded rod threadedly engaging the lever actuator; a means for disengaging the lever actuator from the threaded rod; and a means for connecting the threaded rod to the feed gate.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
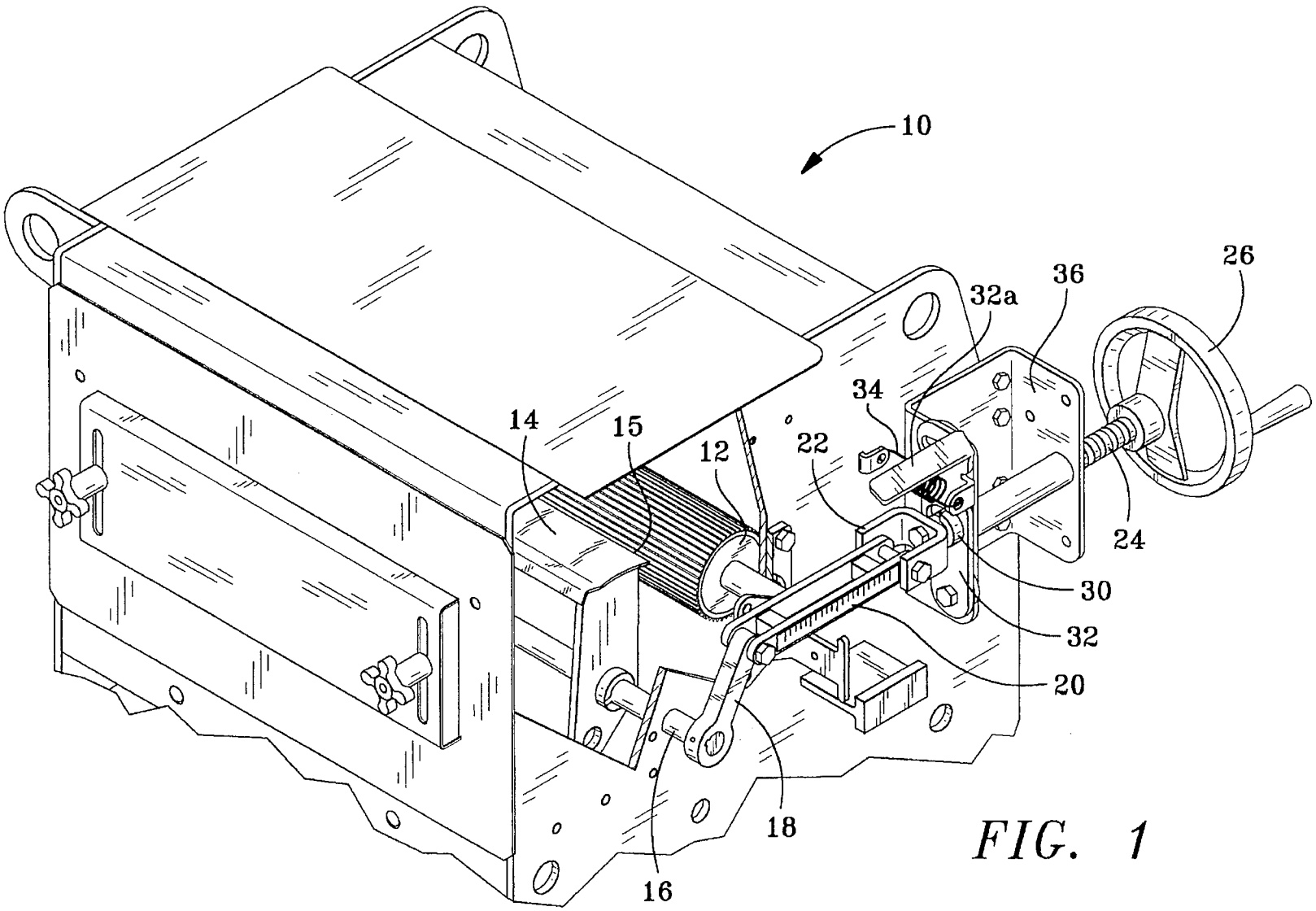
FIG. 1 is a perspective view of a roller mill showing an apparatus for adjusting a feed gate.

FIG. 1 shows a perspective view of part of a roller mill 10. Located inside the roller mill housing are a plurality of rollers 12 (only one is shown). Adjacent roller 12 is a pivotal feed gate 14 with knife edge 15 extending towards roller 12. The feed gate 14 is mounted to shaft 16. A feed gate adjustment mechanism is used to pivot shaft 16 and feed gate 14 to adjust the quantity of feed material flowing into the rollers 12.

The feed gate adjustment includes a hand wheel 26 attached to an acme threaded rod 24. The threaded rod 24 is supported by a mounting bracket 36. Attached to mounting bracket 36 is lever actuator 32 having a lever handle 32*a* extending therefrom. The lever actuator is pivotally attached to mounting bracket at pivot 40. The threaded rod 24 passes through an elongated slot 38 (See FIG. 3) in lever actuator 32. Positioned on one side of slot 38 is a half round nut 30. A spring 34 is attached to the lever actuator 32 and the roll mill housing to bias half round nut 30 into threaded engagement with threaded rod 24.

One end of threaded rod 24 is attached to a clevis 22 which is attached to linkage 20. A feed gate lever 18 connects linkage 20 to feed gate shaft 16. As handwheel 26 is turned, the handwheel 26 and attached threaded rod 24 move linearly with respect to lever actuator 32 because of the threaded engagement with half round nut 30. The linear movement of the threaded rod 24 causes the end of feed gate lever 18 to move which in turn causes feed gate shaft 16 and feed gate 14 to move pivotally closer to or further from roller 12. Because of the threaded engagement of the threaded rod 24 with half round nut 30, this operation is a fine adjust for gradually adjusting the feed flow rate to bring the roller mills up to full operating load.

Figure 3:
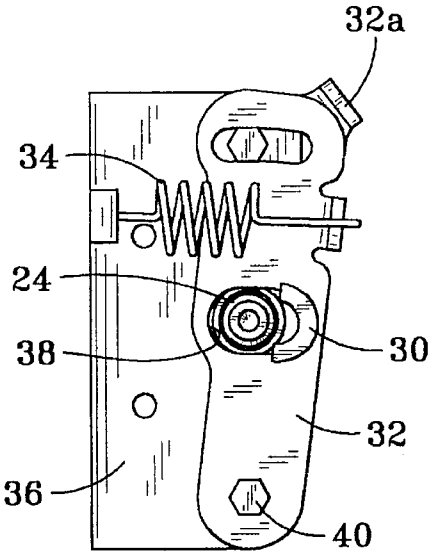
FIG. 3 is a partial view of the apparatus shown in FIG. 2.
Figure 2:
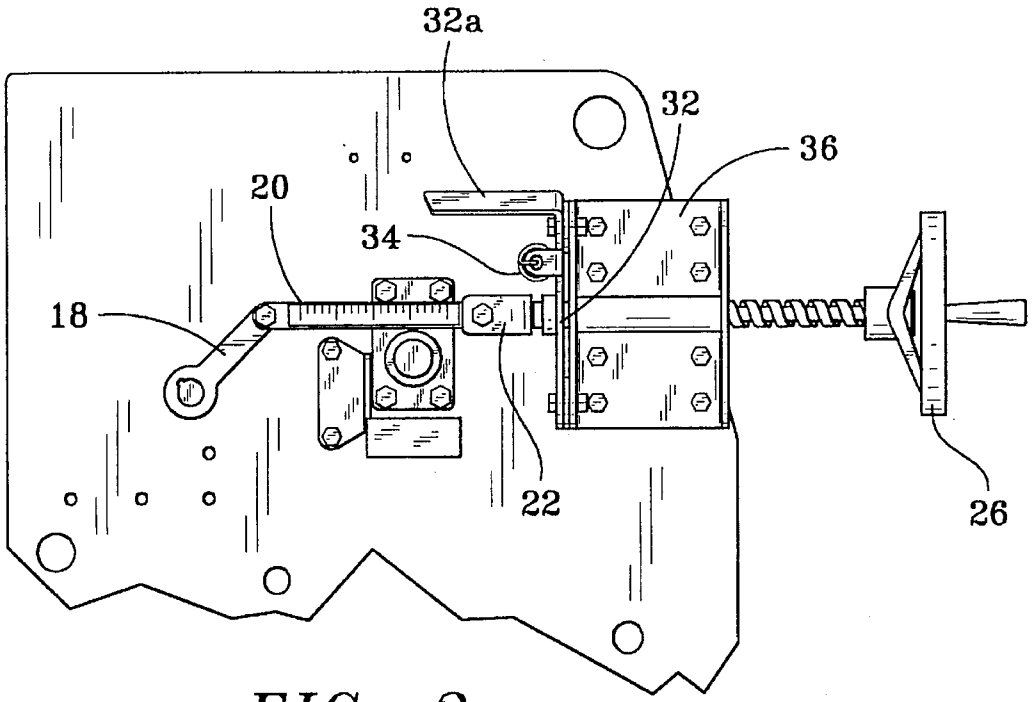
FIG. 2 is a side view of the apparatus shown in FIG. 1.

In the event that quick acting adjustment is necessary to shut off the flow of feed to the roller mill to avoid an overload or choke-up, lever actuator 32 is operated by lever handle 32*a* to pivot the lever actuator 32 about pivot 40 causing half round nut 30 to disengage from threaded rod 24. FIG. 3 shows lever actuator 32 pivoted to disengage half round nut 30 from threaded rod 24. The threaded rod 24 can then be moved freely and rapidly to the desired position thereby causing the feed gate 14 to also move to the desired position.

Lever actuator 32 and half round nut 30 are normally biased into engagement with threaded rod 24 for fine adjustment of the feed gate 14 but can be pulled by hand to release threaded rod 24 from engagement with half round nut 30 for quick acting adjustment.

Having described the invention, what is claimed is:

1. An apparatus for adjusting a feed gate, the apparatus comprising:

a feed gate;

a lever actuator;

a threaded rod threadedly engaging the lever actuator;

a means for disengaging the lever actuator from the threaded rod; and a means for connecting the threaded rod to the feed gate.

2. The apparatus according to claim 1, wherein the means for disengaging the lever actuator comprises a half round threaded nut attached to the lever actuator.

3. The apparatus according to claim 1, wherein the means for disengaging the lever actuator comprises the lever actuator having an aperture therethrough, the threaded rod passing through the aperture, the aperture being larger than the threaded rod diameter.

4. The apparatus according to claim 3, wherein the aperture is an elongated slot.

5. The apparatus according to claim 1, further comprising:

a means for biasing the lever actuator into engagement with the threaded rod.

6. An apparatus for adjusting a feed gate, the feed gate pivoting about an axis, the apparatus comprising:

a feed gate;

a lever actuator;

a linear actuator engaging the lever actuator, the linear actuator being moveable linearly relative to the lever actuator;

a means, connecting the linear actuator to the feed gate, for converting the linear motion of the linear actuator to rotary motion for pivoting the feed gate; and a means for disengaging the lever actuator from the linear actuator whereby the linear actuator can move freely relative to the lever actuator.

7. The apparatus according to claim 6, wherein the lever actuator has a threaded portion thereon and the linear actuator comprises a threaded rod engaging the threaded portion of the lever actuator.

8. The apparatus according to claim 6, further comprising:

a means for biasing the lever actuator into engagement with the linear actuator.

9. An apparatus for adjusting a pivotal feed gate, the apparatus comprising:

a pivotal feed gate;

a lever actuator having a half round threaded nut thereon;

a threaded rod threadedly engaging the half round nut; and a means for connecting the threaded rod to the pivotal feed gate;

the lever actuator being laterally moveable relative to the threaded rod, whereby lateral movement of the lever actuator disengages the half round nut from the threaded rod.

* * * * *